US010889974B2

(12) United States Patent
Gwen

(10) Patent No.: US 10,889,974 B2
(45) Date of Patent: Jan. 12, 2021

(54) TOOL FOR CLEARING A CLOG

(71) Applicant: CORE PACIFIC, LLC, Houston, TX (US)

(72) Inventor: Patrick Gwen, Houston, TX (US)

(73) Assignee: Core Pacific LLC, Houston, TX (US)

( * ) Notice: Subject to any disclaimer, the term of this patent is extended or adjusted under 35 U.S.C. 154(b) by 80 days.

(21) Appl. No.: 16/290,944

(22) Filed: Mar. 3, 2019

(65) Prior Publication Data

US 2020/0277767 A1 Sep. 3, 2020

(51) Int. Cl.
*E03C 1/12* (2006.01)
*E03C 1/304* (2006.01)

(52) U.S. Cl.
CPC ..... *E03C 1/304* (2013.01)

(58) Field of Classification Search
CPC ..... E03C 1/308; E03C 1/306; E03C 1/304; B08B 9/0321
USPC .... 4/255.01, 255.05, 255.11, 255.06, 255.04
See application file for complete search history.

(56) References Cited

U.S. PATENT DOCUMENTS 2,300,319 A * 10/1942 Smith ..... E03C 1/308 4/255.01
2,939,154 A * 6/1960 Gasser ..... E03C 1/304 4/255.01
3,138,803 A * 6/1964 Caplan ..... E03C 1/308 4/255.01
3,280,418 A * 10/1966 Schonberger ..... A47L 13/58 15/261
5,239,708 A 8/1993 Irwin
5,249,311 A * 10/1993 Rau ..... E03C 1/306 15/406
6,550,074 B1 * 4/2003 Allenbaugh ..... B08B 9/0321 4/255.01
7,213,273 B2 * 5/2007 Wang ..... E03C 1/308 4/255.01
7,610,635 B2 11/2009 Schultz
10,683,650 B1 * 6/2020 Wang ..... E03C 1/308
2012/0066823 A1 * 3/2012 Lee ..... E03C 1/308 4/255.11
2013/0198943 A1 * 8/2013 Park, II ..... E03D 9/00 4/255.04

* cited by examiner

*Primary Examiner* — Charles Cheyney
(74) *Attorney, Agent, or Firm* — Craft Chu PLLC; Andrew W. Chu

(57) ABSTRACT

The tool for clearing a clog includes a tool shaft, a nozzle body, and a handle portion. The tool shaft includes an outer tube, an inner tube, and radial supports for the inner tube. The outer tube can be symmetrical so that the nozzle body can be aimed according to alignment of the outer tube. The nozzle body includes a nozzle connector, a sealing member with a hardness less than the nozzle connector and a diameter greater than the nozzle connector, and a nozzle tip. The sealing member can create the seal. The handle portion includes a handle body, handles, a handle chamber with a pin member, air cartridge, and a button member, and a handle body cover. The attachment of the handle body cover sets the button member in a sealed position to release the blast of air from the air cartridge, when moved to the released position.

17 Claims, 3 Drawing Sheets

TOOL FOR CLEARING A CLOG

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a tool for clearing a clog from a pipe. More particularly, the present invention relates to a tool for removing a clog or blockage in toilet plumbing. The present invention further relates to a tool for clearing a clog by a blast of air into the toilet plumbing.

2. Description of Related Art Including Information Disclosed Under 37 CFR 1.97 and 37 CFR 1.98

Clogged drains can lead to messy and embarrassing situations. Depending upon the severity of the clog, there are a variety of mechanical implements that can be used to clear drains. Toilet plumbing includes the passageway through the bottom of the toilet bowl and pipes connected to the passageway. The passageway is curved, so clogs are usually not directly visible through the opening of the passageway. The clogs are also not directly touchable at the opening of the passageway either. The opening has a gradual transition zone from the toilet bowl to the passageway, so the opening may be generally conical with different contours and shapes. The opening is larger and wider than most of the passageway, and the shape may be irregular, in contrast to the generally tubular portion of the passageway connected to pipes.

A mechanical implement is the plumber's snake. This device is a flexible coil with an auger end, which is inserted into the drain to physically contact and displace the clog or blockage. The plumber's snake normally includes a coiled metal wire with an auger end and a crank attached to the metal wire. The crank rotates the metal wire as the plumber's snake enters the drain. The auger end has screw threads for boring into a clog. The combination of the rotation of the wire and the boring action of the auger end results in clearing a clog or blockage. There is the corkscrew action of the auger end to dig into the clog. The clog can be pulled out of the drain with the auger end anchored into the clog. There is the rupture of the clog with the snake drilling through the blockage, allowing some fluid to pass through the clog to break down the clog. Additionally, the mechanical action of rubbing the auger end and the coil against the blockage loosens and breaks the clog.

Another mechanical implement is the auger strip, which includes an elongated flexible strip for insertion directly into the drain pipe. The strip has a length to physically reach the clog, and barbs are located along the length of the strip. The tip of the strip punctures, rubs, twists, and engages the clog for removal. The barbs scrap and impale the clog or other clogging fragments along the length of the drain pipe. The clog and fragments are snagged on the strip, and the strip is removed from the pipe by pulling the handle end from the drain. The snagged clog and fragments are removed from the pipe along with the strip.

A common alternative to the mechanical implements is the plunger, which uses pressure pulses to unclog a blockage in a pipe. Instead of a mechanism to physically contact the clog or blockage, a plunger uses air as an initial pressure pulse into the toilet plumbing and vacuum action to loosen a clog. The plunger includes a shaft and a rubber cup at one end of the shaft. The free end of the shaft is the handle, used to place the plunger into position. The cup is positioned to cover the mouth of the drain in the water. Using the handle, the cup is pushed towards the drain. Air in the cup is forced into the drain to break the clog, while the cup is flattened. Using the handle again, the cup is pulled into its original shape, causing a vacuum. The vacuum also acts to loosen or break the clog. The reciprocating air push and the vacuum pull work to clear the clog or other blockage in the drain. The plunger can be used on other drains besides a toilet drain, such as a sink drain or bath tub drain. Although the clog is not physically contacted by the plunger, the water and particles of the clog will contact the cup during the actuation of the cup.

The conventional tools to clear clogs from toilet plumbing are unsanitary from direct contact with the clog. Human waste and other biological materials of the clog can contaminate the conventional tools. The auger may have smears of the clog or trapped hair in the screw threads, and the cup of the plunger may be submerged in water and waste particles freed from the clog. These re-useable tools require cleaning, especially if these tools are stored in a separate location.

The conventional tools also require physical strength and coordination. Users with different physical capabilities, such as a disable or elderly person, may not be able to effectively work these conventional tools. The physical strength and stamina for the reciprocating action of a plunger may not be available for all users.

Discharging a pulse of air or fluid without contacting the clog or remnants of the clog and without strenuous activity by the user have developed as alternatives to the conventional tools to clear clogs. Various patents have been granted for these sudden burst tools to clear drains. U.S. Pat. No. 5,239,708, issued to Irwin on 31 Aug. 1993, discloses a mechanically operated pneumatic device. Reciprocating action builds air pressure in an air chamber for a triggered release through a check valve. The burst of air cleared the drain separate from the reciprocating action. U.S. Pat. No. 6,550,074, issued to Allenbaugh on 22 Apr. 2003, discloses another device with a compressed air cartridge triggered to discharge into toilet plumbing to clear a drain. The cartridge discharges by a push button without any physically challenging movements to building the air pressure for discharging the air pulse. The cartridge pressurizes an upper chamber, and a burst disk between the upper chamber and a lower chamber releases the pulse of air to the toilet plumbing.

The sudden burst tools present particular new concerns. The pulse of air from a cartridge at the top end of the device must travel to the bottom end of the device without losing effectiveness and without dissipating the magnitude of pressure to be exerted against a clog further in the toilet plumbing. There is a need for more than one cartridge so that the device can be used for more than one device. The handle positions can also be mounted more ergonomically for easier handling and positioning. The pulse of air must be triggered for release at the proper angle into the toilet plumbing so that the pulse of air is most effective to remove a clog. Additionally, the sealing at the opening of the passageway of the toilet plumbing must be stable and strong enough to withstand the blast of air. Furthermore, the blast of air must be safe, such that any sudden burst tool must have a release by valve or other mechanism to avoid damage and injury caused by too much air pressure released by the cartridge.

It is an object of the present invention to provide a tool for clearing a clog from toilet plumbing.

It is another object of the present invention to provide embodiments of a clog clearing tool without direct contact with the clog or clog remnants.

It is another object of the present invention to provide embodiments of a clog clearing tool that can be used with less physical exertion than a plunger.

It is an object of the present invention to provide a tool to release a blast of air to remove a clog from toilet plumbing.

It is another object of the present invention to provide embodiments of an air blast tool with stable fluid connection between a cartridge of compressed gas or air and the outlet of the air blast tool.

It is another object of the present invention to provide embodiments of an air blast tool with an adjustable seal in fluid connection between the cartridge of compressed gas or air.

It is still another object of the present invention to provide embodiments of the air blast tool with a safety valve between the adjustable seal and the fluid connection between the cartridge and the outlet.

It is still another object of the present invention to provide embodiments of the air blast tool with the adjustable seal in an inflated configuration before the discharge from the outlet of the tool.

These and other objectives and advantages of the present invention will become apparent from a reading of the attached specifications and appended claims.

BRIEF SUMMARY OF THE INVENTION

Embodiments of the present invention include the tool for clearing a clog comprising a tool shaft, a nozzle body, and a handle portion. The tool releases a blast of air to remove a clog in a plumbing. In particular, the tool clears toilet plumbing without contacting the blockage. The tool is mounted to the toilet plumb to form a seal. The tool is aligned to aim the blast of air and then triggered to release the blast of air. The blockage is removed without physical contact so that clearing the clog is sanitary and safe. There is no large physical movement by the user. There is no pumping or thrusting action to release the blast of air. Along with sealing and aiming of the tool, a user with any level of physical capability is able to clear a clog cleanly and efficiently.

In some embodiments, the tool shaft includes an outer tube, an inner tube coaxially aligned within the outer tube, and a plurality of radial supports between the inner tube and the outer tube within the outer tube. The outer tube can have a symmetrical cross-section that is also radially symmetrical, such as a triangular cross-section. The nozzle body can be aimed according to alignment of the outer tube. The radial supports can be distributed equally around the inner tube, and the outer tube, inner tube and radial supports can be made integral and formed by extrusion.

The invention includes the nozzle body mounted to the distal end of the tool shaft. The nozzle body has a nozzle connector, a sealing member, and a nozzle tip. The nozzle connector connects directly to the distal end of the tool shaft and has a fluid connection with the inner tube. The sealing member is positioned around the nozzle connector and has a diameter greater than the nozzle connector. The hardness of the nozzle connector is greater than the hardness of the sealing member. The sealing member is deformable to fit against plumbing fixtures, while the nozzle connector maintains shape during release of the blast of air without deforming. The nozzle tip has a nozzle outlet and a means for attaching to the nozzle connector. The sealing member is between the nozzle tip and the nozzle connector to be in fluid connection with the inner tube through the nozzle connector. The nozzle connector can have a first tubular portion aligned with the inner tube and a second tubular portion angled from the first tubular portion. The angled second tubular portion allows improved aiming of the tool, when the plumbing is bent, such as toilet plumbing. There can also be a one-way valve as a safety valve in the nozzle tip to prevent backflow, after the release of the blast of air.

Embodiments also include the handle portion mounted to the proximal end of the tool shaft. The handle portion includes a handle body connected to the outer tube, a plurality of handles extending outward from the handle body, a handle chamber in fluid connection with the inner tube, a pin member mounted within the handle chamber, an air cartridge positioned within the handle chamber, a button member connected to the handle chamber, and a handle body cover being attached to the handle body opposite the proximal end of the tool shaft. The air cartridge is set in a loaded position with the pin member puncturing the air cartridge so as to release air from the air cartridge to the handle chamber. This loaded position corresponds to the handle body cover in the locked position. The button member has a sealed position and a released position. When handle body cover is in the locked position and the air cartridge is in the loaded position, the button member can be in the sealed position so as to close the fluid connection between the air cartridge and the inner tube. To release the blast of air, the button member is actuated or pressed to move into the released position so as to open the fluid connection between the air cartridge and the inner tube and so as to release air from the air cartridge in the handle chamber to the inner chamber and through the nozzle outlet.

Alternative embodiments of the invention include ergonomic positions of the handles relative to the tool shaft or at least the axis of the tool shaft. The positions of the handle can also aim the tool. Also, there can be level indicator in the handle body cover. The level indicator can also be used to aim the tool before pressing the button member to release the blast of air.

DETAILED DESCRIPTION OF THE INVENTION

Referring to FIGS. 1-5, the present invention is a tool 10 for clearing a clog. The tool 10 releases a blast of air to remove a clog in a plumbing, in particular toilet plumbing. With a clog in a toilet, there are sanitary concerns. Prior art plumbing snakes and augers physically contact the clog for removal. Waste material can be smeared and spread on the tools, which require diligent cleaning before re-use. The tool 10 of the present invention clears toilet plumbing without contacting the clog or blockage. Embodiments of the present invention include the tool 10 for clearing a clog comprising a tool shaft 20, a nozzle body 30, and a handle portion 50.

Figure 2:
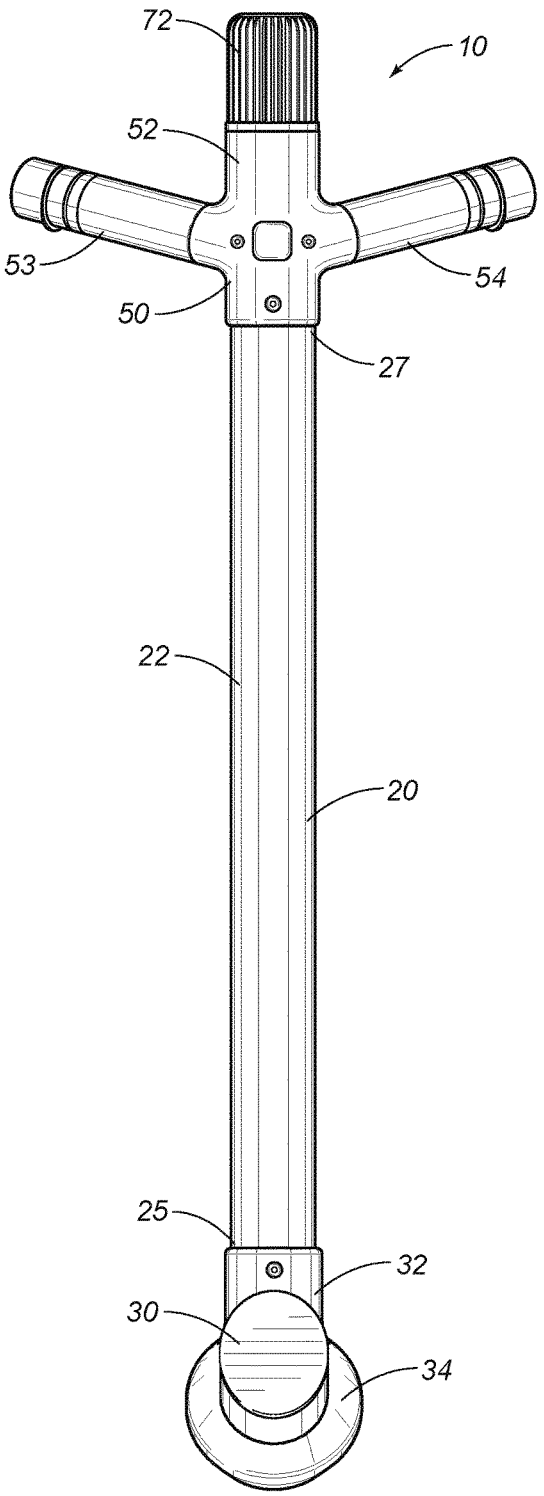
FIG. 2 is a back elevation view of an embodiment of the tool for clearing a clog according to the present invention.
Figure 3:
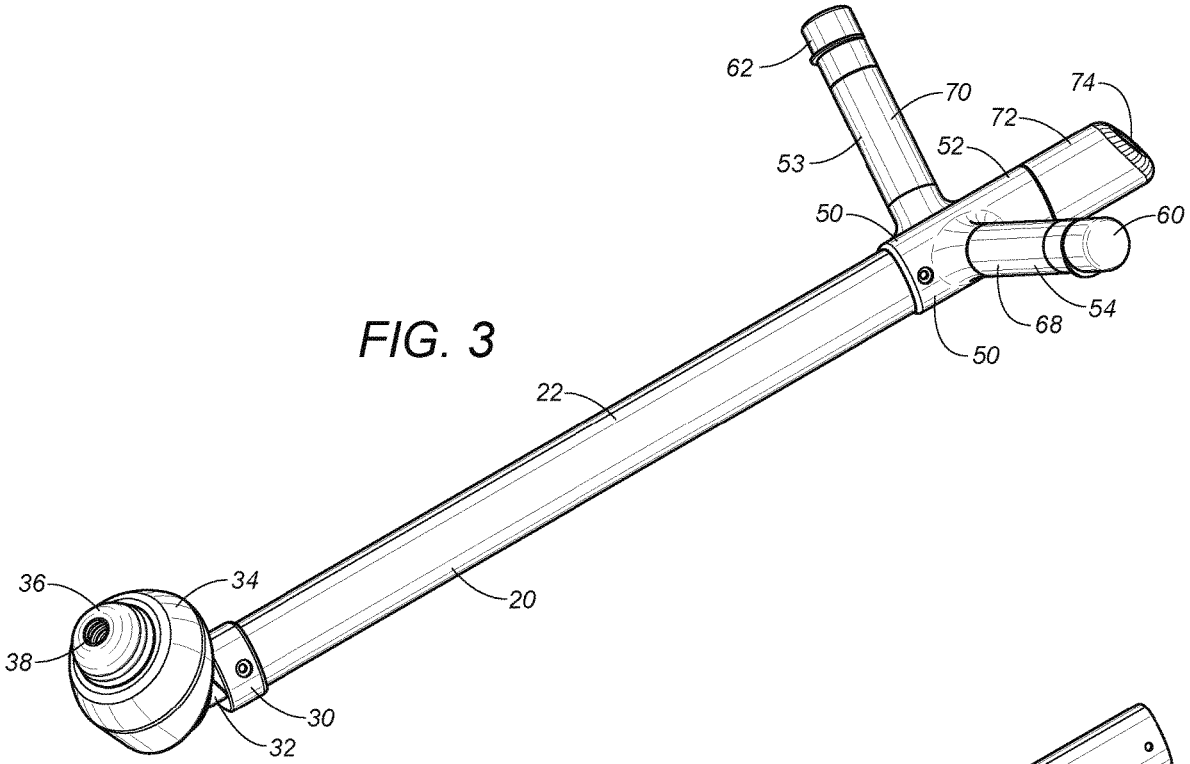
FIG. 3 is a side perspective view of an embodiment of the tool for clearing a clog according to the present invention.
Figure 4:
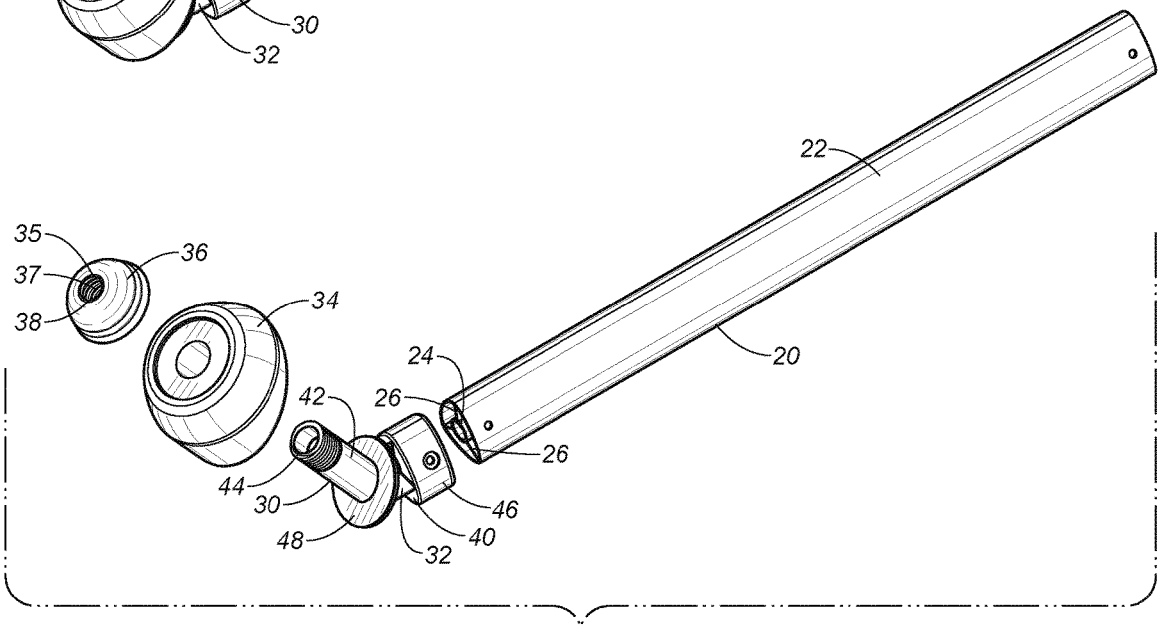
FIG. 4 is an exploded perspective view of an embodiment of the distal end of the tool according to the present invention.

FIGS. 1-4 show the tool shaft 20 being comprised of an outer tube 22, an inner tube 24 coaxially aligned within the outer tube 22, and a plurality of radial supports 26 between the inner tube 24 and the outer tube 22 within the outer tube 22. The tool shaft 20 has a distal end 25 and a proximal end 27 opposite the distal end 25. FIG. 4 shows the outer tube 22 have a cross-section that is radially symmetric and symmetric across a midline. In particular, FIG. 4 shows the outer tube 22 with a triangular cross-section. The nozzle body 30 can be aimed according to alignment of the outer tube 22. Consistency in aiming is important so that the blast of air is effectively released to best remove the clog.

FIG. 4 also shows that the radial supports 26 can be distributed equally around the inner tube 24. FIG. 4 shows three radial supports 26. In this embodiment, the outer tube 22, inner tube 24, and radial supports 26 can be made integral for strength and consistency. The tool shaft 20 can be formed by an extrusion process so that the tool 10 can easily be modified for different dimensions with the same consistency. There is no loose inner tubing or separate chambers for the blast of air to travel from the handle portion 50 to the nozzle body 30.

FIGS. 1-4 also show the nozzle body 30 mounted to the distal end 25 of the tool shaft 20. The nozzle body 30 is furthest away from the user and is positioned within the toilet bowl when clearing a clog from toilet plumbing. The shape of toilet plumbing has bends and curves, so the nozzle body 30 must be compatible with different configurations of toilet plumbing. A consistent seal on the toilet plumbing affects the power and efficiency of the blast of air. A weak seal releases the blast of air into the toilet bowl, which can splash unsanitary toilet water on the user and which can reduce the strength of the blast contacting the clog within the toilet plumbing.

Figure 1:
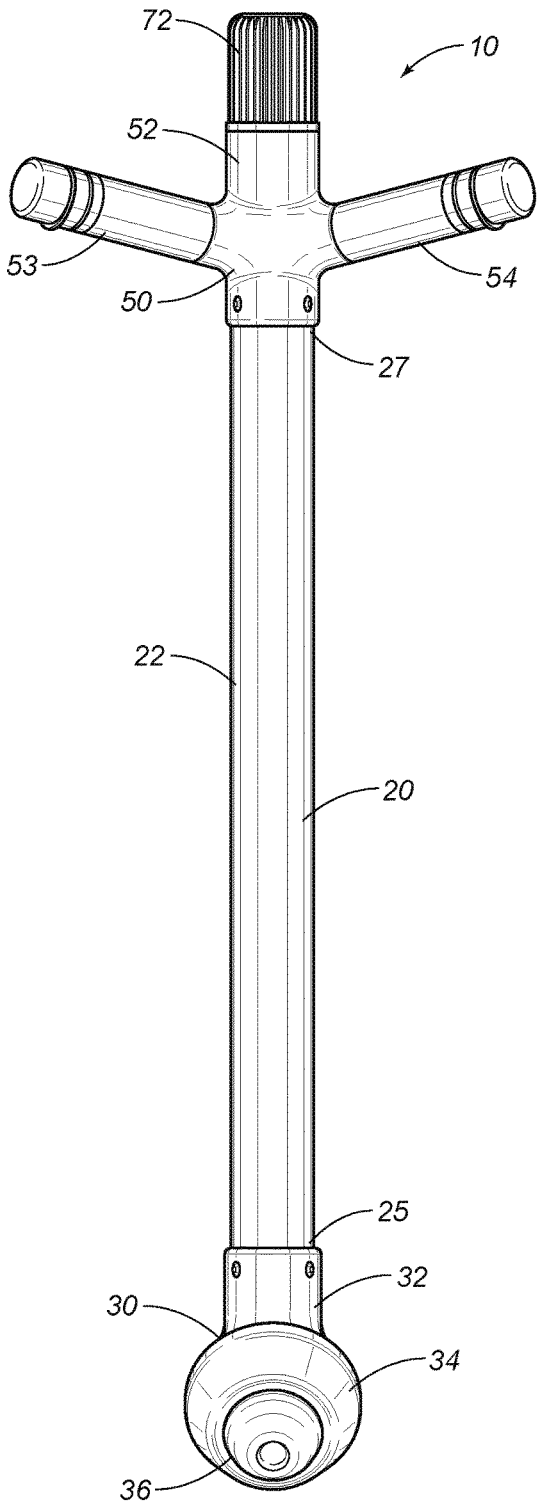
FIG. 1 is a front elevation view of an embodiment of the tool for clearing a clog according to the present invention.

In embodiments of the present invention, FIGS. 1-3 show the nozzle body 30 being comprised of a nozzle connector 32 being connected to the distal end 25 of the tool shaft 20, a sealing member 34 being positioned around the nozzle connector 32, and a nozzle tip 36 with the sealing member 34 between the nozzle tip 36 and the nozzle connector 32. The assembled nozzle body 30 is shown in FIGS. 1-3 with fluid connection from the inner tube 24 to the nozzle tip 36 through the nozzle connector 32. The nozzle connector 32 is in fluid connection with the inner tube 24 and is comprised of a first material with a first hardness, while the sealing member 34 is comprised of a second material with a second hardness and has a diameter greater than the nozzle connector 32. The first hardness is greater than the second hardness. The sealing member 34 is deformable to fit against plumbing fixtures, while the nozzle connector 32 maintains shape during release of the blast of air without deforming. The tool 10 is compatible with any plumbing fixture and toilet plumbing with any curves or bends. The sealing member 34 can form a seal to the plumbing without losing strength of the blast of air through the nozzle connector 32 and nozzle tip 36.

FIG. 4 shows an embodiment of the nozzle body 30 with a nozzle tip 36 being comprised of a nozzle outlet 35 and a means for attaching 38 to the nozzle connector 32. The means for attaching 38 can be screw threads, as shown in FIG. 4, or other known components, such as snap-fit or male-female connectors. In this embodiment of FIG. 4, the nozzle connector 32 is comprised of a first tubular portion 40 being in fluid connection with the inner tube 24 and being coaxially aligned with the inner tube 24, and a second tubular portion 42 being in fluid connection with the first tubular portion 40 and being angled relative to the first tubular portion 40. The second tubular portion 42 has a complementary means 44 for attaching to the nozzle tip 36. The nozzle connector 32 is bent so that the blast of air is not aligned with the tool shaft 20. The angle of the second tubular portion 42 relative to the first tubular portion 40 and the tool shaft 20 enables better and consistent sealing to the plumbing and better aim of the blast of air. Plumbing is more likely to have curves, so the tool 10 incorporates this relationship in the nozzle connector 32.

FIG. 4 further shows embodiments with the first tubular portion 40 being comprised of an attachment collar 46 connected to the outer tube 22. The attachment collar 46 fits the cross-section of the outer tube 22 so as to align the nozzle body 30 and the tool shaft 20 for aiming the blast of air. The attachment collar 46 also maintains the fluid connection with the inner tube 24 so that the blast of air is efficiently directed through the tool 10 with less change of diameter, and subsequent less lost of air speed by a widening diameter. FIG. 4 also shows an embodiment with the second tubular portion 42 being comprised of a blocking ring 48. The sealing member 34 is positioned between the attachment collar 46 and the nozzle tip 36 at the blocking ring 48. As the sealing member 34 is deformed, the sealing member 34 remains separate from the first tubular portion 40 and the tool shaft 20. Alternate embodiments of the nozzle tip 36 include the nozzle tip 36 being further comprised of a one-way valve 37 between the nozzle outlet 35 and the tool shaft 20. Still another alternate embodiment is the one-way valve 37 positioned within the nozzle connector 32, instead of the nozzle tip 36. The one-way valve 37 improves sanitary conditions by preventing backflow into the tool 10.

FIG. 4 also shows the second tubular portion 42 having a complementary means 44 for attaching to said nozzle tip 36. As such the complementary means for attaching 44 can be screw threads as shown in FIG. 4 or other snap fit or male-female connectors or others.

FIGS. 1-3 and 5 show the embodiments of the handle portion 50 mounted to the proximal end 27 of the tool shaft 20. The handle portion 50 stores the source of the blast of air and provides for aiming the blast of air. Additionally, the handle portion 50 includes the trigger element to release the blast of air without requiring large physical movements by the user. FIGS. 1-3 show an assembled handle portion 50 being comprised of a handle body 52 being connected to the outer tube 22, a plurality of handles 53, 54 extending outward from the handle body 52, a handle chamber 78 being positioned within the handle body 52 and being in fluid connection with the inner tube 24, a pin member 80 being mounted within the handle chamber 78, an air cartridge 82 being positioned within the handle chamber 78, a button member 84 connected to the handle chamber 78, and a handle body cover 72 being attached to the handle body 52 opposite the proximal end 27 of the tool shaft 20.

FIGS. 1-3 show the embodiments of the handles 53, 54 in ergonomic positions relative to the tool shaft 20 or at least the axis of the tool shaft. The handles 53, 54 are positioned for the most efficient access by the user. The spacing and position relative to the handle body 52 allows for the button member 84 to be pressed, while the user has a stable grip on the tool 10. The positions of the handles 53, 54 can also aim the tool 10, in addition to the shape of the outer tube 22. FIGS. 1-3 show the plurality of handles 53, 54 as angled outward from the tool shaft 20 and away from the nozzle body 30. From the axis of the tool shaft 20, the handles 53, 54 spread outward and upward from the nozzle body 30. These embodiments show the handles 53, 54 aligned with the nozzle body 30 with the nozzle body 30 co-axial with the tool shaft 30 and the handles 53, 54 being symmetrically set on either side of the tool shaft 20.

Figure 5:
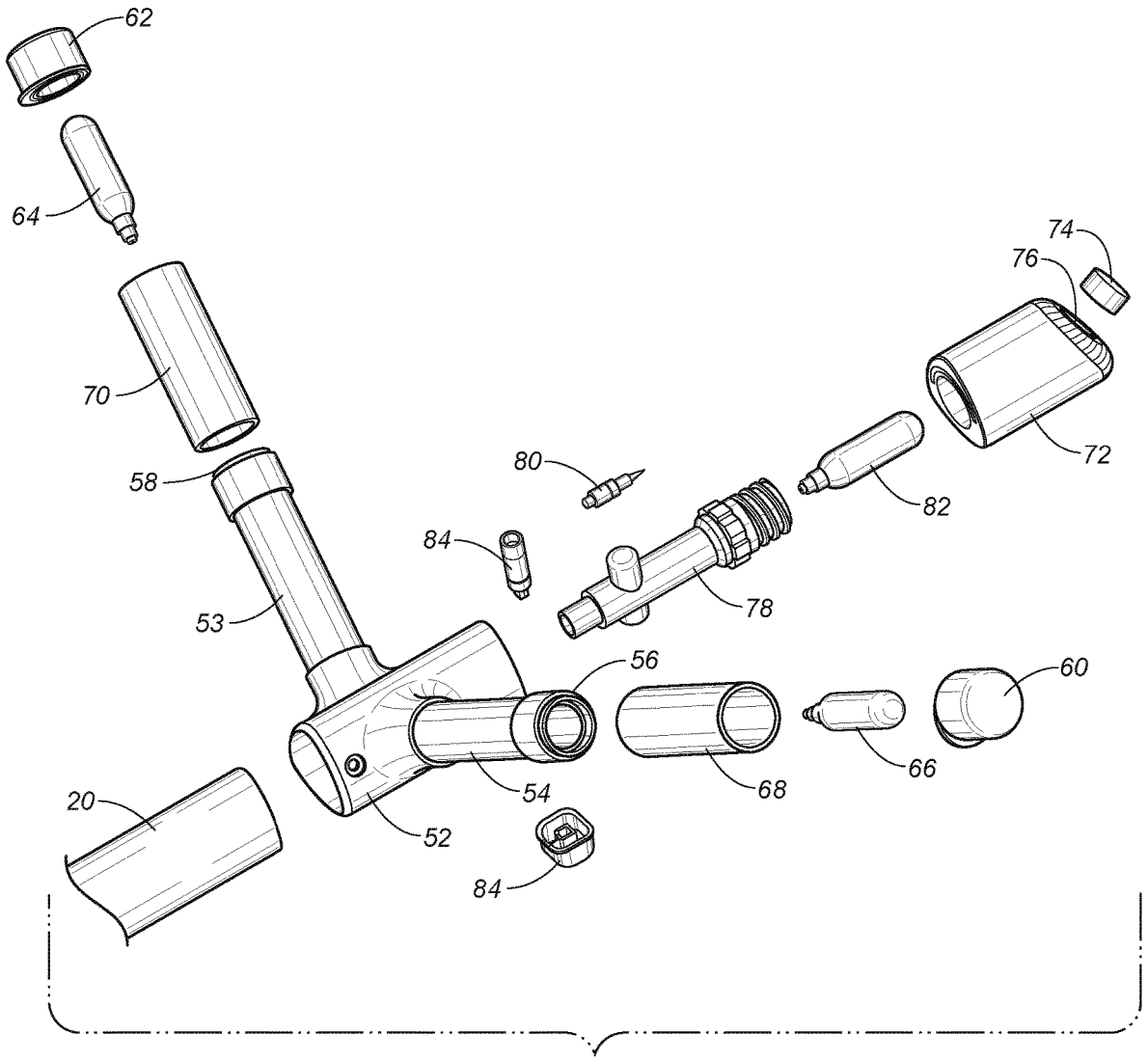
FIG. 5 is an exploded perspective view of an embodiment of the handle portion of the tool according to the present invention.

FIG. 5 shows another embodiment of the handle portion 50 with a level indicator 74 in the handle body cover 72. The level indicator 74 is used to aim the tool 10 before pressing the button member 84 to release the blast of air. The handle body cover 72 can have an end surface 76 on an end of the handle body 30. This end surface 76 may be angled relative to the handle body 52, in particular, angled to the axis of the handle body 52 (an coaxially aligned tool shaft 20). A level position shown by the level indicator 74 corresponds to a proper release angle for the pulse of air through the nozzle body 30. In other words, the handles 53, 54 can be used to place the bubble of the level indicator 74 between the lines of the level indicator 74, which corresponds to aiming the nozzle body 30 into the toilet plumbing. This level indicator 74 increases the accuracy of the blast of air to the clog.

FIGS. 1-3 and 5 further show the embodiment of the present invention for the handle portion 50. The air cartridge 84 is set in a loaded position with the pin member 80 puncturing the air cartridge 82 so as to release air from the air cartridge 84 to the handle chamber 78. This loaded position corresponds to the handle body cover 72 in the locked position. The handle body cover 72 is completely screwed or snap fit into place on the handle body 52, forcing the pin member 80 to puncture the air cartridge 82. The amount of force to set the locked position of the handle body cover 72 is the most force needed to release the blast of air. There is no pumping or dynamic movements to release the blast of air. Assembling the handle body cover 72 sets the loaded position of the air cartridge 84 with pressurized air loaded into the handle chamber 78.

The button member 84 has a sealed position and a released position. The button member 84 has the sealed position, when the handle body cover 72 is attached. The default position is the button member 84 in the sealed position. This sealed position closes the fluid connection between the air cartridge 82 (and handle chamber 78 filled with pressurize air) and the inner tube 24. To release the blast of air, the button member 84 is actuated or pressed to move into the released position so as to open the fluid connection between the air cartridge 82 and the inner tube 24. The pressurized air from the air cartridge 82 in the handle chamber 78 is released to the inner tube 24 and through the nozzle outlet 36. These components allow the puncture of the air cartridge 82 without a large or dynamic physical movement by the user. Users of all physical abilities will be able to release the blast of air by pressing the button member 84, instead of lunging or pumping in big physical movements that require a level of strength.

FIG. 5 shows an embodiment of the handle portion 50 with each handle 53, 54 being comprised of an inner handle chamber 56, 58 and a corresponding handle cap 60, 62 so as to removably store a plurality of air cartridges 64, 66. The tool 10 can store extra air cartridges for multiple uses of the tool 10. The handle cap 60, 62 can be screw fit, snap fit, male female, or removably attached by any known means. FIG. 5 also shows each handle 53, 54 comprising a plurality of hand grips 68, 70 for each handle 53, 54. These hand grips 68, 70 allow for better aiming and sealing of the nozzle body 30. The hand grips 68, 70 can be friction fit to each handle 53, 54. The handles 53, 54 can be made integral with the handle body 50. The placement of the handles 53, 54 matches the shape of the outer tube 22 so that alignment of the symmetrical cross section of the outer tube 22 sets the handles 53, 54 symmetrically on both sides of the tool shaft 20.

The present invention is a tool for clearing a clog from plumbing, in particular, toilet plumbing with bends and curves and different opening dimensions corresponding to the selection of the toilet. The tool has a sealing member and nozzle connector to accommodate and make an effective seal based on the differential hardness of the two components. The flexibility to make an effective seal no longer sacrifices the strength of the blast of air. The sealing member does not deform by the blast of air, since the harder nozzle connector maintains the fluid connection for the blast of air. The tool can clear a clog without direct contact with the clog or clog remnants. There is a one-way valve to prevent back flow at the nozzle body.

The tool of the present invention is compatible with all users. A strong physical force is no longer required to puncture the air cartridge. A large physical movement or dramatic action is no longer required to trigger the release of the blast of air. Additionally, there is no dynamic or dramatic motion to break the alignment or knock the nozzle body out of place at the time of the release of the blast of air through the nozzle body. There is less physical exertion than a plunger. The handle body cover can be screwed in to the handle body at the locked position to set the air cartridge in the loaded position. The pressurized air is released to the handle chamber. The button member now controls the release of the blast of air instead of a dramatic puncturing of the air cartridge. The user actuates the button member from the default sealed position to the released position, opening the fluid connection between the handle chamber and the inner tube, and consequently, the nozzle body and out through the nozzle outlet. The button member can be an adjustable seal in fluid connection between the air cartridge of compressed gas or air. Additionally, the tool includes a one-way safety valve at the nozzle body. The one-way valve protects the inner tube and the button member in the handle portion from back flush. The nozzle outlet is isolated so that any backflow does not contaminate the tool, which can now be re-used more easily. The sealed configuration of the button member is the adjustable seal in an inflated configuration with the pressurized air in the handle chamber before the discharge from the nozzle outlet of the tool.

The tool of the present invention also increases the consistency of the blast of air. The tool can be aimed. The outer tube can be used to indicate alignment with the nozzle body. The position of the handles on either side of the tool shaft can be used to indicate alignment of the nozzle body. Additionally, a level indicator on the handle portion can show the proper angle of the tool shaft for the aiming for the most efficient angle for the release of the blast of air. The handles in an ergonomic position and angle from the tool shaft can support the aiming and stability when pressing the button member to fire or release the blast of air.

The foregoing disclosure and description of the invention is illustrative and explanatory thereof. Various changes in the details of the illustrated structures, construction and method can be made without departing from the true spirit of the invention.

I claim:

1. A tool for clearing a clog, comprising:

a tool shaft being comprised of an outer tube, an inner tube coaxially aligned within said outer tube, and a plurality of radial supports between said inner tube and said outer tube within said outer tube, said tool shaft having a distal end and a proximal end opposite said distal end;

a nozzle body mounted to said distal end of said tool shaft, said nozzle body being comprised of:

a nozzle connector being connected to said distal end of said tool shaft, being in fluid connection with said inner tube, and being comprised of a first material with a first hardness;

a sealing member being positioned around said nozzle connector and being comprised of a second material with a second hardness, said first hardness being greater than said second hardness, said sealing member having a diameter greater than said nozzle connector; and a nozzle tip being comprised of a nozzle outlet 36 and a means for attaching to said nozzle connector, said sealing member being between said nozzle tip and said nozzle connector, said nozzle outlet being in fluid connection with said inner tube through said nozzle connector; and a handle portion mounted to said proximal end of said tool shaft, said handle portion being comprised of:

a handle body being connected to said outer tube;

a plurality of handles extending outward from said handle body;

a handle chamber being positioned within said handle body and being in fluid connection with said inner tube;

a pin member being mounted within said handle chamber;

an air cartridge being positioned within said handle chamber and having a loaded position with said pin member puncturing said air cartridge so as to release air from said air cartridge to said handle chamber;

a button member connected to said handle chamber and having a sealed position and a released position relative to said inner tube, said handle chamber and said air cartridge, wherein said button member is in said sealed position so as to close the fluid connection between said air cartridge and said inner tube, and wherein said button member is in said released position so as to open the fluid connection between said air cartridge and said inner tube and so as to release air from said air cartridge in said handle chamber to said inner tube and through said nozzle outlet; and a handle body cover being attached to said handle body opposite said proximal end of said tool shaft in a locked position.

2. The tool, according to claim 1, said outer tube having a cross-section being radially symmetric.

3. The tool, according to claim 2, said outer tube having a triangular cross-section.

4. The tool, according to claim 1, said plurality of radial supports being equally distributed around said inner tube within said outer tube.

5. The tool, according to claim 1, said plurality of radial supports being made integral with said inner tube and said outer tube.

6. The tool, according to claim 1, said nozzle connector being comprised of:

a first tubular portion being in fluid connection with said inner tube and being coaxially aligned with said inner tube; and a second tubular portion being in fluid connection with said first tubular portion and being angled relative to said first tubular portion, said second tubular portion having a complementary means for attaching to said nozzle tip.

7. The tool, according to claim 6, said first tubular portion being comprised of an attachment collar 46 connected to said outer tube.

8. The tool, according to claim 6, said second tubular portion being comprised of a blocking ring 48, said sealing member being between said attachment collar and said nozzle tip.

9. The tool, according to claim 6, said nozzle tip being further comprised of:

a one-way valve between said nozzle outlet and said tool shaft.

10. The tool, according to claim 6, said nozzle connector being further comprised of:

a one-way valve being positioned between said nozzle tip and said tool shaft.

11. The tool, according to claim 1, wherein each handle comprises an inner handle chamber and a corresponding handle cap so as to removably store a plurality of air cartridges.

12. The tool, according to claim 11, further comprising: a plurality of hand grips, each hand grip corresponding to a respective handle.

13. The tool, according to claim 1, wherein said plurality of handles are angled outward from said tool shaft and away from said nozzle body.

14. The tool, according to claim 1, wherein said plurality of handles are angled outward and upward away from said nozzle body.

15. The tool, according to claim 1, wherein said plurality of handles is aligned with said nozzle body, said nozzle body being aligned on said tool shaft, said handles being angled symmetrically from said tool shaft.

16. The tool, according to claim 1, further comprising:

a level indicator being made integral with said handle body cover, said handle body cover having an end surface angled relative to said handle body.

17. The tool, according to claim 1, wherein said loaded position of said air cartridge corresponds to said handle body cover connected to said handle body in said locked position.

* * * * *